United States Patent [19]

Cekala

[11] Patent Number: 4,543,754

[45] Date of Patent: Oct. 1, 1985

[54] CLIP-ON CHIMNEY HOOD

[76] Inventor: John A. Cekala, 3134 Pine Ave., Altoona, Pa. 16601

[21] Appl. No.: 536,614

[22] Filed: Sep. 28, 1983

[51] Int. Cl.[4] ..... E04H 12/28

[52] U.S. Cl. ..... 52/218; 110/119; 98/122; 98/66.1

[58] Field of Search ..... 52/218, 199, 244, 72, 52/200; 98/122, 66 R; 110/119; 55/DIG. 20, DIG. 19, 309, 507

[56] References Cited

U.S. PATENT DOCUMENTS

| | | | |
|---|---|---|---|
| 293,526 | 2/1884 | Scholl | 98/66 R |
| 1,452,259 | 4/1923 | Snell | 98/122 |
| 1,622,431 | 3/1927 | Feigenbaum | 110/119 |
| 1,641,102 | 8/1927 | Slocum | 55/309 |
| 1,709,884 | 4/1929 | Slocum | 110/119 |
| 1,719,846 | 9/1929 | Matlevish | 52/218 |
| 3,017,954 | 1/1962 | Kruckewitt | 55/507 |

*Primary Examiner*—James L. Ridgill, Jr.
*Attorney, Agent, or Firm*—William J. Ruano

[57] ABSTRACT

A clip-on chimney hood comprising a substantially circular, oval, or inverted U-shaped spring integrally attached to a hood. A preferred material for the spring is a utility cable which can be formed into a loop by slipping each of the loop ends, of a length of cable, into a short metal sleeve and then welding or brazing. Either a single or double loop is attached to a hood which may be either corrugated or of flat sheet metal extending at right angles to the loop or loops. The spring loop or loops are inserted into the chimney, or a chimney liner, and frictionally held therein. The distance between the hood and top of the chimney or liner, may be easily adjusted simply by detaching a few wire fasteners at the lower edges of the hood which allows the hood edges to always rest on the chimney for added stability. Maximum hood opening accommodates coal or wood burning while minimum opening accommodates gas or oil burning. Since the chimney hoods are simply clipped onto the chimney, no fastening elements are needed and easy adjustability is provided.

20 Claims, 12 Drawing Figures

CLIP-ON CHIMNEY HOOD

This invention relates to a chimney hood and, more particularly, to one that can be clipped onto the interior of a chimney or chimney liner without the need of fastening elements.

An outstanding disadvantage of conventional chimney hoods is that they generally require fastening elements for securing to the chimney. Such fastening elements, in time, will rust or deteriorate from the weather and heat in the chimney. Moreover, a further disadvantage is that the hood is not relatively adjustable in height from the chimney to accommodate different types of fuel burning.

An object of the invention is to provide a novel clip-on chimney hood that overcomes the above-named difficulties.

A more specific object of the invention is to provide a novel clip-on chimney hood that can be easily and quickly mounted or dismounted from a chimney without the necessity of fastening elements.

Another object of the invention is to provide an improved chimney hood structure that easily enables adjustment of the distance between the hood and top of the chimney or its liner.

Other objects and advantages of the invention will become more apparent from a study of the following description taken with the accompanying drawing wherein.

Figure 1:
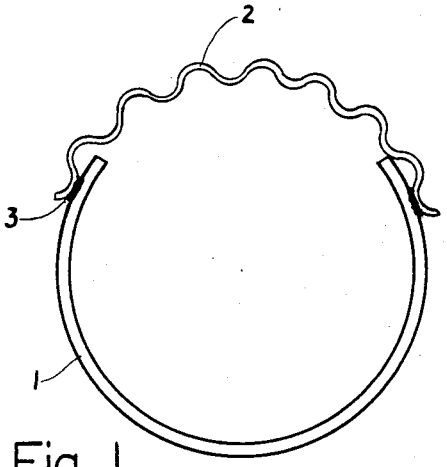
FIG. 1 is an elevational view of one form of a clip-on chimney hood embodying the present invention.
Figure 1A:
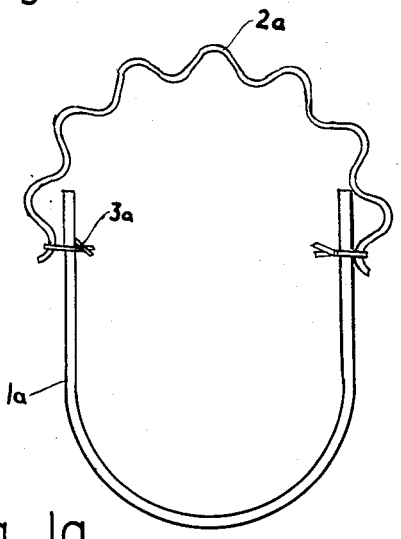

FIG. 1*a* is an elevational view of the structure of FIG. 1 when squeezed and fitted in a chimney or liner.

Figure 3:
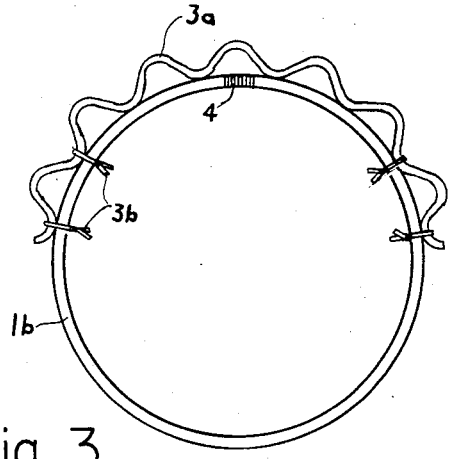
Figure 3A:
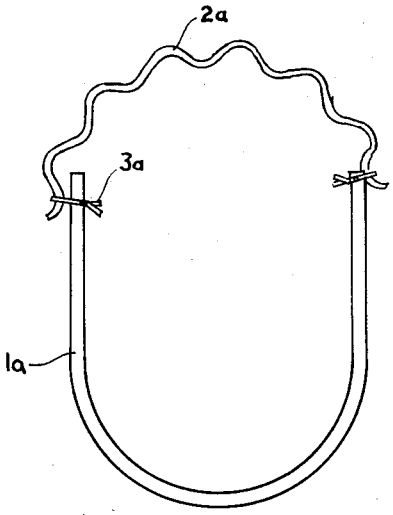
Figure 4:
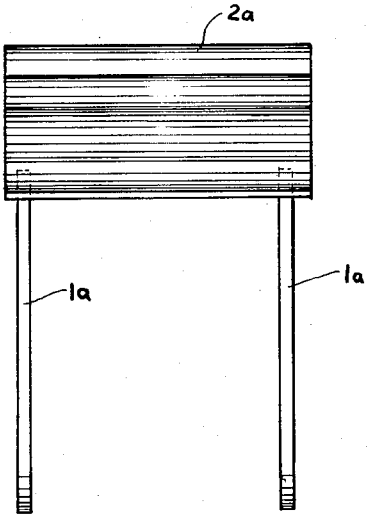
Figure 5:
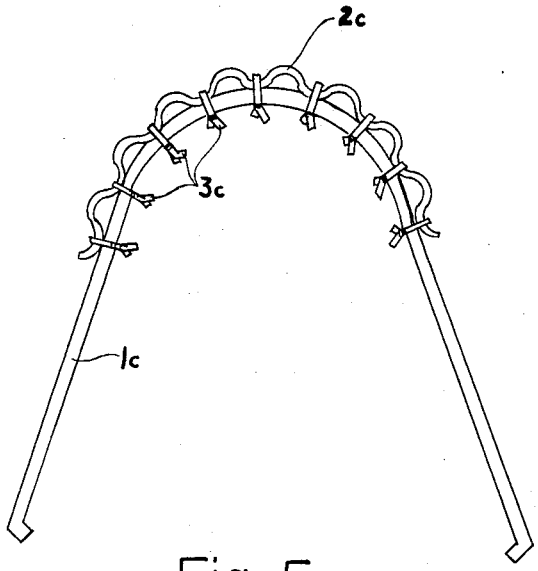
Figure 5A:
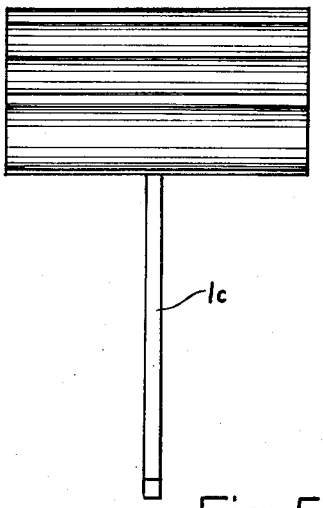
Figure 6:
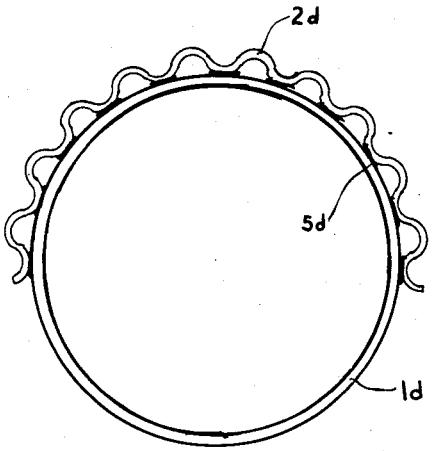
Figure 7:
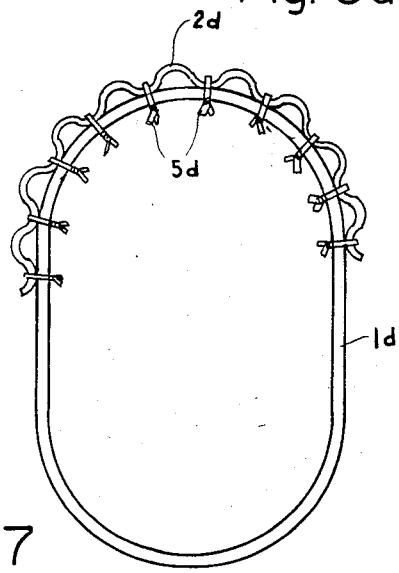
Figure 8:
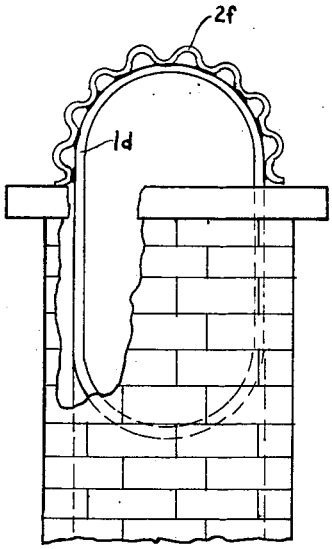
Figure 9:
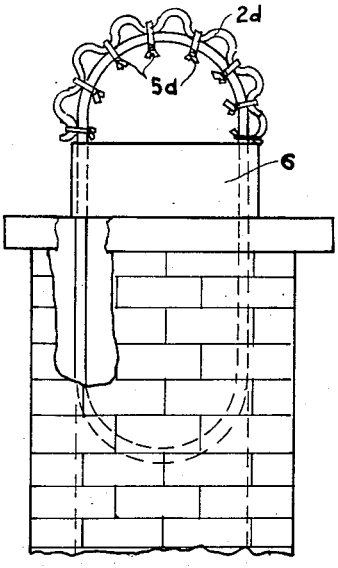

FIG. 3 is a further modification of the circular cable having mounted, on a portion thereof, a corrugated hood;

FIG. 3*a* is a further modification of FIG. 1 when squeezed and fitted in a chimney or liner showing a U-shaped spring of either metal or cable having a corrugated hood attached to the extremeties thereof by means of wire fasteners;

FIG. 4 is a side view of the hood assembly shown in FIG. 3;

FIG. 5 shows a still further modification involving an inverted U-shaped spring having a corrugatd hood attached to a central portion thereof;

FIG. 5*a* is a side view of the hood assembly shown in FIG. 5;

FIG. 6 is a still further modification showing a circular spring or cable to which is welded or brazed a corrugated hood;

FIG. 7 is a still further modification after being squeezed to fit into a chimney or liner, showing a loop of oval shape with a corrugated hood secured thereto by removable fastening means;

FIG. 8 shows still another modification, similar to FIG. 7, when supported inside a chimney; and FIG. 9 shows the modification of FIG. 7 and illustrating the hood assembly 2 supported by the liner of the chimney.

Referring more particularly to FIG. 1, numeral 1, denotes a portion of a ring of spring steel or utility cable to the end portions of which is secured a corrugated sheet of non-corrosive metal or other suitable material. The ends are welded or brazed or otherwise fastened to the end portions of spring 1. As will be noted in FIG. 2, a pair of springs, such as 1, are employed but is should be understood that a single spring 1 secured to the central portion of the hood, such as the modification shown in FIG. 5*a*, may be used instead.

FIG. 1*a* shows a U-shaped spring or cable after being squeezed to fit into a chimney or liner, to the ends of which are secured a corrugated hood 2*a* by means of welding or brazing.

FIG. 3 shows a hoop-like spring 1*b* which may be made either of spring metal or from a piece of utility cable whose ends are inserted in a sleeve 4 snugly fitted thereon and which may be welded or brazed to the cable at least at central portions. A corrugated hood 3*a* is mounted on the upper third of the spring 1*b* by means of fastening elements of wire 3*b* and by said welding and brazing.

Figure 2:
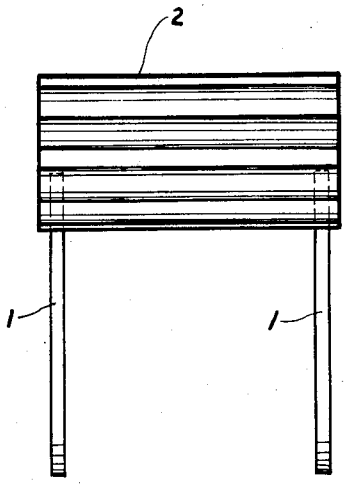
FIG. 2 is a side view of FIG. 1.

FIG. 3*a* shows a structure nearly identical with FIG. 1*a* but wherein removable fastening elements 3*a* are provided instead of welding or brazing. However, either a double spring as shown in FIG. 2, or a single spring may be used instead as shown in FIG. 5*a*, in the modifications of FIG. 1, FIG. 3, FIG. 6 and FIG. 7.

FIG. 5 shows a further modification embodying an inverted U-shaped spring 1*c* having mounted, on its central portion, a corrugated hood 2*c* by means of welding or brazing or wire fasteners 3*a* while the end portions may be held only by removable wire fasteners. There may be a single wire 1*c*, as shown in FIG. 5*a*, or a double wire as shown in FIG. 2.

FIG. 6 shows a still further modification involving a wire hoop 1*d* of metal or utility cable to which is welded or brazed, at points 5*d*, a corrugated hood 2*d*.

FIG. 7 shows a modification of FIG. 6, after being squeezed to fit a chimney or liner, comprising an oval shaped spring 1*d* of metal or of utility cable having attached, by means of non-corrosive fastening elements 5*d*, a hood 2*d*.

FIG. 8 shows a structure such as in FIG. 6 after being squeezed to fit in a chimney, and illustrating how the ends of the hood are supported directly on top of the chimney.

FIG. 9 shows a modification similar to FIG. 7 wherein the ends of the hood are supported directly on a chimney liner 6. When it is desired to provide a smaller opening between the hood and the chimney liner, the end fasteners are removed to accommodate gas burning instead of coal or wood burning.

The spring has a dual function by acting as a frame for the hood and as a fastening means by clipping onto the interior of the chimney or its liner. Moreover, the spring and hood assembly is of lower cost than conventional hood structures.

Thus it will be seen that I have provided a chimney hood that can be easily and quickly slipped onto the inner surface of a chimney or chimney liner and which can be easily adjusted in height relative to the top of the chimney.

While I have illustrated and described several embodiments of my invention, it will be understood that these are by way of illustration only and that various changes and modifications may be contemplated in my invention and within the scope of the following claims:

I claim:

1. In combination with a chimney having an interior opening a chimney hood assembly comprising a loop of spring wire extending across said interior opening, and an arcuate hood attached to said loop at right angles thereto and along substantially the entire extent of said interior opening, the width of said loop being somewhat greater than the said interior opening of said chimney, whereby when the loop is squeezed and inserted into the interior of the chimney, it will expand into frictional line contact with the interior of said chimney.

2. The combination recited in claim 1 wherein said loop is formed of a utility cable.

3. The combination recited in claim 1 wherein said hood is of corrugated sheet metal.

4. The combination recited in claim 1 wherein said hood is of flat sheet metal.

5. The combination recited in claim 1 wherein said loop is of inverted "U" shape.

6. The combination recited in claim 1 wherein said loop is in the form of a partial circle.

7. The combination recited in claim 1 wherein said loop is circular.

8. The combination recited in claim 1 wherein said hood is welded to said loop.

9. The combination recited in claim 1 wherein said hood is attached by wires to said loop.

10. The combination recited in claim 1 wherein said hood is welded to said loop at central portions of the hood and is attached by wire fasteners at end portions of the hood.

11. The combination recited in claim 1 wherein the ends of said hood rest on top of said chimney.

12. The combination recited in claim 1 together with a chimney interior liner extending above the top of said chimney, the ends of said hood resting on top of said liner.

13. The combination recited in claim 1 together with a second loop of spring wire, said loops being connected to the end portions of said hood and being parallel to each other.

14. The combination recited in claim 5 together with a second loop parallel to said first mentioned loop, and of identical construction, said loops being attached to end portions of said hood.

15. The combination recited in claim 7 together with a second loop parallel to said first mentioned loop, and of identical construction, said loops being attached to end portions of said hood.

16. The combination recited in claim 1 wherein said loop is of "U" shape, a second loop parallel to said first mentioned loop and of identical construction, said loops being attached to end portions of said hood.

17. The combination recited in claim 9 together with a second loop parallel to said first mentioned loop and of identical construction, said loops being detachably secured by said wires to said hood.

18. A chimney hood assembly comprising a pair of loops of spring wire adapted to extend across the interior opening of said chimney and being in spaced parallel relationship, an arcuate hood having end portions attached to said loops, the width of said loops being greater than said interior opening, whereby when said loops are squeezed and inserted into the interior of said chimney, they will expand into frictional line contact with said interior of said chimney.

19. A chimney hood assembly as recited in claim 18 wherein said loops are in the form of a partial circle.

20. A chimney hood assembly as recited in claim 18 wherein said loops are in the form of a circle.

* * * * *